United States Patent [19]

Langen et al.

[11] 4,414,309

[45] Nov. 8, 1983

[54] PHOTOGRAPHIC RECORDING MATERIAL CONTAINING AN ALDEHYDE REMOVER

[75] Inventors: Hans Langen, Bonn; Lothar Rosenhahn, Cologne; Erich Wolff, Solingen, all of Fed. Rep. of Germany

[73] Assignee: Agfa-Gavaert Aktiengesellschaft, Leverkusen, Fed. Rep. of Germany

[21] Appl. No.: 444,452

[22] Filed: Nov. 24, 1982

[30] Foreign Application Priority Data

Dec. 4, 1981 [DE] Fed. Rep. of Germany ..... 3148108

[51] Int. Cl.[3] ..... G03C 1/40

[52] U.S. Cl. ..... 430/551; 430/542; 430/554; 430/555; 430/614; 430/623

[58] Field of Search ..... 430/551, 614, 214, 542, 430/554, 555, 623, 372

[56] References Cited

U.S. PATENT DOCUMENTS

| | | | |
|---|---|---|---|
| T900,028 | 7/1972 | Rush | 430/607 |
| 2,895,827 | 7/1959 | Callear et al. | 430/531 |
| 3,168,400 | 2/1965 | Blackmer et al. | 430/372 |
| 3,511,663 | 5/1970 | Mariani et al. | 430/614 |
| 3,652,278 | 3/1972 | Asano et al. | 430/608 |
| 3,811,891 | 5/1974 | Dariak et al. | 430/621 |
| 4,003,748 | 1/1977 | Langen et al. | 430/551 |

*Primary Examiner*—J. Travis Brown
*Attorney, Agent, or Firm*—Connolly & Hutz

[57] ABSTRACT

Compounds corresponding to the following general formula wherein $R^1$ represents hydrogen, an aliphatic or cycloaliphatic group, an aralkyl group, an aryl group, a heterocyclic group or one of the following groups: —CO—alkyl, —CO—aryl, —CO—heterocyclic group, —$SO_2$—alkyl, —$SO_2$—aryl, —CO—O—alkyl, —CO—NH—$NH_2$, and $R^2$ represents hydrogen, an aliphatic or cycloaliphatic group, an aralkyl group, an aryl group, alkoxy, aroxy, carboxyl, carbamoyl, alkoxycarbonyl, an alkyl or aryl group attached through a carbonyl group, cyanogen, an amino group optionally substituted by alkyl, aralkyl, aryl or acyl, or a cyclic amino group may be used as additives in the layers of color photographic recording materials to improve the stability of color couplers, in particular magenta couplers, against formaldehyde.

5 Claims, No Drawings

PHOTOGRAPHIC RECORDING MATERIAL CONTAINING AN ALDEHYDE REMOVER

This invention relates to a photographic recording material having at least one silver halide emulsion layer containing a compound capable of reacting as aldehyde scavenger.

Photographic recording materials normally consist of a layer support with light-sensitive gelatine-containing silver halide emulsion layers applied thereto and optionally also light-insensitive auxiliary layers containing gelatine. The light-sensitive silver halide gelatine emulsion layers of colour photographic recording materials contain the colour components required to produce the image dyes in the three primary colours. The aforesaid multilayered recording materials used in black-and-white and colour photography and methods for the preparation thereof are well known and have been described, for example, in Ullmanns Enzyklopädie der technischen Chemie, 4th Edition, Volume 18, in the Chapter entitled "Photografie".

Since the gelatine layers of which the photographic recording material is composed must not undergo undue swelling during processing and must have sufficient mechanical strength in order not to be damaged, they are treated with cross-linking agents, also known as hardeners. The substances used as hardeners may be either inorganic or organic photographically inert compounds capable of cross-linking gelatine by way of the carboxyl groups or amino groups. Examples of known hardeners include aldehydes, such as formaldehyde, glyoxal and glutaraldehyde, aldehydric acids, such as mucochloric acid, diketones, such as diacetyl, dihalides, such as 1,3-dichloropropanol, bis-vinylsulphone compounds, diisocyanate-bisulphite compounds, bis-epoxides, bis-aziridines, peptide reagents, such as carbodiimides, N-carbamoyl-pyridinium salts and isoxazolium salts, and substituted 2,4-dichlorotriazines, e.g. N,N',N''-tris-acryloyl-perhydro-s-triazine.

It is known that the use of the aforesaid aldehydes, such as formaldehyde, glyoxal, glutaraldehyde or succinaldehyde, as hardeners is associated with certain difficulties. Not only may aldehydes bring about a cross-linking of gelatine layers which is difficult to limit, but they are also liable to impair the function of the colour components contained in the layers and may give rise to fogging. This disadvantageous effect may also occur when aldehydes are not deliberately incorporated in the photographic materials, but penetrate the photographic layers, e.g. when a photographic material is unintentionally stored in an atmosphere containing aldehydes. This situation may occur when photographic materials are stored in furniture manufactured from plywood which has been glued with an adhesive which liberates formaldehyde, e.g. a melamine/formaldehyde resin or a phenol/formaldehyde resin. When a photographic material is stored in such a piece of furniture, the formaldehyde released from the glue may cause substantial fogging of the photographic layers, thereby invariably impairing the quality of the photographic images produced from this material. In the case of a colour photographic material, the loss in quality due to the aldehyde will be even more marked since in this case the aldehyde also interferes with the $\gamma$-balance of the three emulsion layers producing the colour image.

It has been attempted to overcome the difficulties due to aldehydes described above by adding so-called "aldehyde scavengers" to the photographic materials, that is to say compounds which are capable of trapping the aldehyde.

According to De-A 1,722,816 for example, N,N'-ethylene urea, 2,3-dihydroxynaphthalene or dimedon is added to photographic layers to fix the formaldehyde. According to DE-A 2,332,426, a photographic recording material contains an acyclic urea as aldehyde scavenger in addition to a vinyl sulphonyl hardener in one of its colloid layers. U.S. Pat. No. 3,652,278 describes a process for reducing the fog in photographic materials which are to be stored in an atmosphere containing formaldehyde. In this process, a compound selected from N,N'-ethylene urea, 2,3-dihydroxynaphthalene and 1,1-dimethyl-3, 5-diketocyclohexane is incorporated in the silver halide emulsion of the material.

According to U.S. Pat. No. 2,309,492, photographic materials containing an aldehyde hardener are processed in the presence of an organic compound which is capable of reacting with the aldehyde. Such compounds include hydroxylamines, hydrazines, hydrazo compounds, semicarbazides, naphthalene diamine, and dimethyl-dihydroresorcinol. U.S. Pat. No. 3,168,400 also relates to a process for the stabilization of photographic images which involves hardening the binder of the photographic recording material with an aldehyde, after exposure, but before development, and them removing unused aldehyde by treatment with the aqueous solution of an amine compound. Examples of suitable amines include hydroxylamine, semicarbazide, hydrazine, biuret and amino guanidine. According to DE-A 2,227,144, photographic materials containing aldehyde are treated in baths containing hydroxylamine and/or a water-soluble salt of hydroxylamine and an aromatic polyhydroxyl compound having two hydroxyl groups in the ortho-position, e.g. an o-dihydroxyl compound of the benzene series.

None of these known measures are satisfactory in preventing the damage to the photographic recording material caused by the above-described action of aldehydes.

It is an object of the present invention to provide a photographic recording material which is protected against fogging, in particular when subjected to prolonged storage under the influence of aldehydes, and in which the contrast and sensitivity are not adversely affected by such storage.

According to the present invention, this problem is solved by means of a light-sensitive colour photographic recording material having at least one silver halide emulsion layer and a colour coupler associated therewith, which material contains an aldehyde scavenger in at least one light-sensitive or light-insensitive layer of binder, characterised in that the aldehyde scavenger used is a compound corresponding to the following general formula:

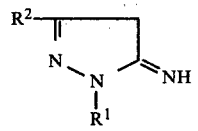

wherein $R^1$ represents hydrogen, an aliphatic or cycloaliphatic group, an aralkyl group, an aryl group, a heterocyclic group or one of the following groups: —CO—alkyl, —CO—aryl, —CO—heterocyclic, —$SO_2$—alkyl, —$SO_2$—aryl, —CO—O—alkyl, —CO—NH—$NH_2$,

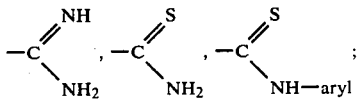

and $R^2$ represents hydrogen, an aliphatic or cycloaliphatic group, an aralkyl group, an aryl group, alkoxy, aroxy, carboxyl, carbamoyl, alkoxycarbonyl, an alkyl or aryl group attached to a carbonyl group, cyanogen, an amino group optionally substituted by alkyl, aralkyl, aryl or acyl, or a cyclic amino group.

The groups $R^1$ and $R^2$ may thus have a wide variety of meanings. They may contain a total of up to 40 carbon atoms, but there is no specified minimum to the number of carbon atoms.

Examples of suitable aliphatic groups include straight- and branched-chain alkyl and alkenyl groups, such as methyl, ethyl, isopropyl, t-butyl, hexyl, dodecyl, allyl, isopropenyl or 3-vinyl ethyl. Suitable cycloaliphatic groups include cycloalkyl and cycloalkenyl groups, such as cyclopentyl, cyclohexyl, bicyclo[2,2,1-]heptyl, 7,7-dialkyl-bicyclo[2,2,2]heptyl, 2-pentadecyl-7,7-dimethyl-bicyclo[2,2,1]heptyl, cyclopentenyl, cyclohexenyl and $\Delta^2$-bicyclo[2,2,1]heptenyl.

Benzyl and phenethyl are examples of suitable aralkyl groups; phenyl and naphthyl are examples of suitable aryl groups.

The above-mentioned alkyl, alkenyl, cycloalkyl, cycloalkenyl, aralkyl and aryl groups may in turn contain substituents, such as halogen atoms, nitro, cyano, alkoxy, aroxy, $CF_3$, amino, sulpho or sulphamoyl.

A carbamoyl group represented by $R^2$ may be mono- or di-substituted on the nitrogen atom, e.g. by alkyl or aryl or by two groups which together with the nitrogen atom complete a cyclic amino group.

An amino group represented by $R^2$ may be substituted, as mentioned above, in particular by a phenyl group (anilino) which may in turn carry substituents; or by an acyl group (acylamino), the acyl group being derived from an aliphatic or aromatic carboxylic or sulphonic acid or from a carbamic acid, a sulphamic acid or a carbonic acid monoester. Examples of suitable cyclic amino groups include the pyrrolidino, piperidino and morpholine groups.

The hetercyclic groups mentioned in the definition of $R^1$ may be, for example, pyridyl, thienyl, pyrazolinyl or S,S-dioxothiolyl.

It has surprisingly been found that, although 5-imino-2-pyrazolines are structurally very closely related to pyrazolin-2-ones-5 used as magenta couplers, and although they are highly reactive towards formalin, they do not, like the magenta couplers, react with oxidized colour developer under processing conditions to form azomethine dyes. In contrast to the known compounds, the novel formalin acceptors are very little dependent in activity upon the relative atmospheric humidity.

Typical examples of compounds suitable for the purposes of the present invention are indicated below.

1.
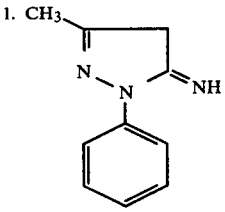

2.
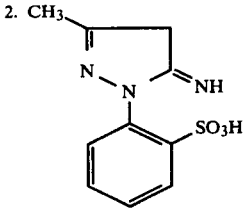

3.
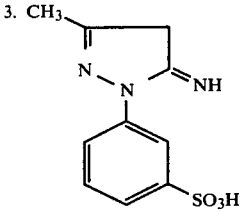

4.
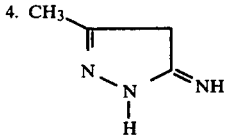

5.
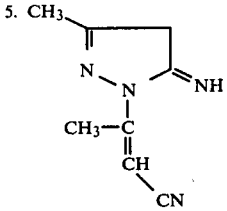

6.
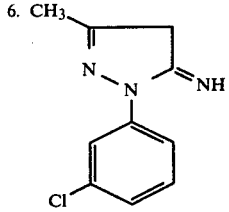

7.
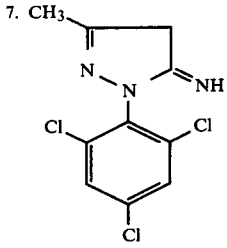

8.
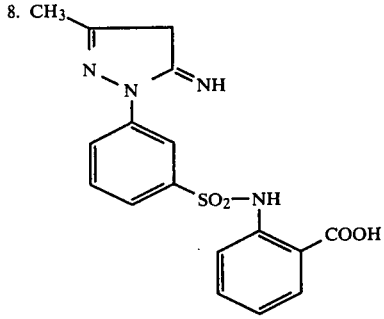

9.
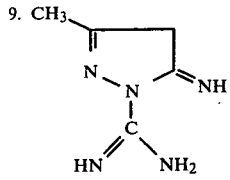

10.
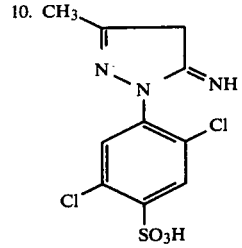

-continued
11. 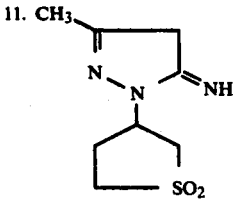
12. 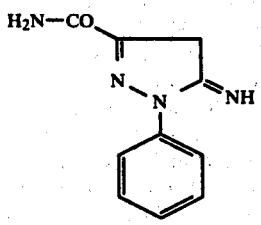
13. 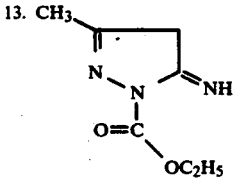
14. 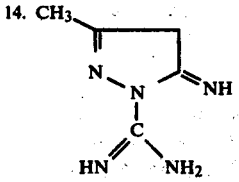
15. 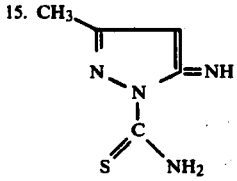
16. 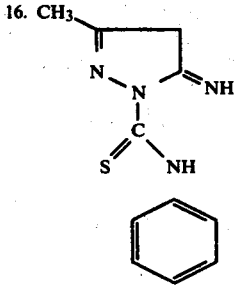
17. 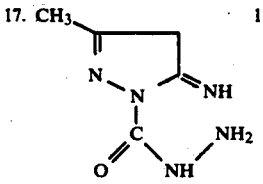
18. 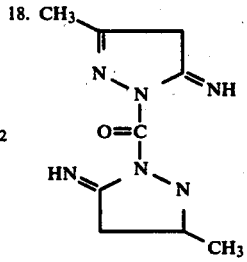
19. 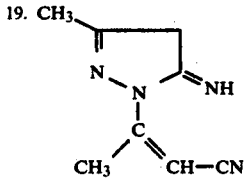
20. 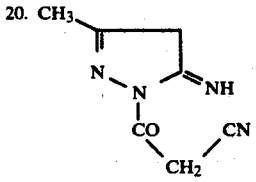
21. 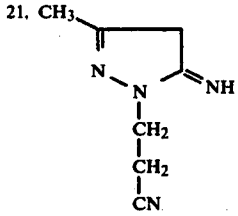
22. 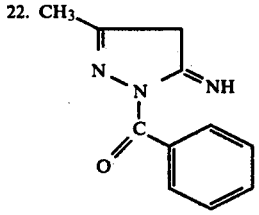
-continued
23. 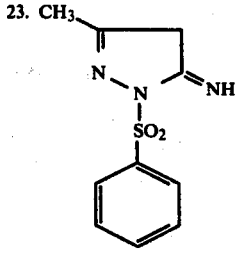
24. 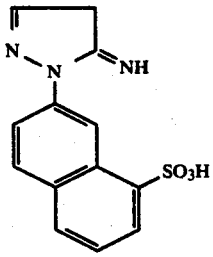
The 5-imino-2-pyrazolines according to the present invention may be synthesized by the following routes:
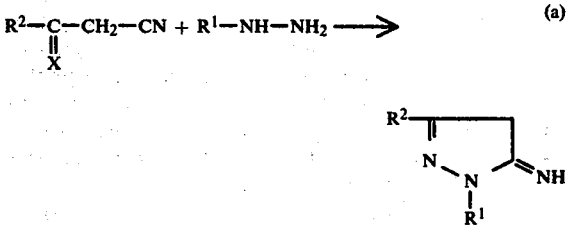
(a)
X=0, NH
Gazz. chim. ital. 81, 380 (1951)
Gazz. chim. ital. 82, 373 (1952)
J. prakt. Chem. 83, 171 (1911)
Ann: 526, 22 (1936)
Ber. 57, 332 (1924)
Il Farmaco (Pavia), Ed. Sci. 10, 691 (1955)
Ann. 397, 119 (1913)
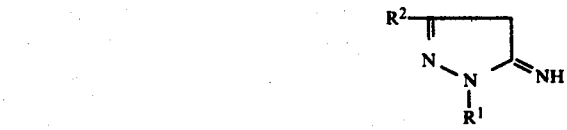
(b)
Compt. rend 143, 1239 (1906)
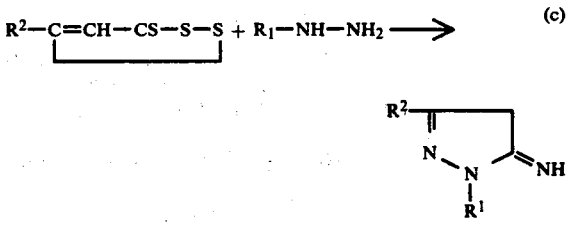
(c)
Ann. 568, 227 (1950)
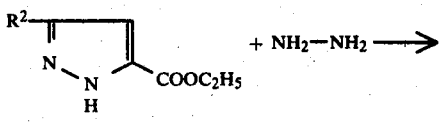
(d)

-continued

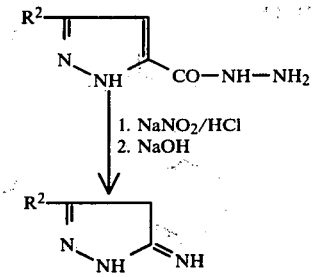

J.A.C.S. 73, 4664 (1951)

A summary of the various methods is given in the monograph by R. H. Wiley and P. Wiley, "The Chemistry of Heterocyclic Compounds", Pyrazolones, Pyrazolidones and Derivatives, Interscience Publishers (1964).

The 5-imino-2-pyrazolines according to the present invention may be introduced into the layers of photographic recording materials together with the conventional components, such as hardeners, cross-linking agents, UV absorbents, DIR couplers and masking couplers, without adversely affecting or being affected by these additives. The binder for the photographic layers is preferably gelatine.

The novel aldehyde scavengers may be added either to the casting solution of one of the layers or to casting solutions of several layers of the photographic recording material, depending on the conditions required for casting. It is generally sufficient to coat the recording material with a top layer containing 5-imino-2-pyrazoline. This is sufficient to protect the layer combination against penetration by aldehyde vapours. The use of 5-imino-2-pyrazolines in this form has proved to be particularly suitable for multilayered colour photographic materials. Since the 5-imino-2-pyrazolines according to the present invention are to a certain extent diffusible, the quantity of 5-imino-2-pyrazoline introduced with the covering layer may be calculated to ensure that the quantity of compound diffusing into the combination of layers during the drying process will be uniformly distributed within those layers of the combination which contain the colour components, whereby an optimum protective effect will be achieved.

The 5-imino-2-pyrazolines may be introduced into the layers either as solutions in water or as solutions in a water-miscible solvent, depending on the solubility and crystallisation tendency thereof. It is particularly advantageous to use low boiling solvents which may easily be removed when the photographic material is cast, e.g. methanol, ethanol, propanol, butanol, acetone, methyl ethyl ketone or acetonitrile.

The quantity of 5-imino-2-pyrazoline compounds to be used depends, of course, on the amount of protection to be conferred on the photographic material. It will therefore depend on the aldehyde concentration envisaged, the sensitivity of the constituents of the photographic material to be protected and the solubility of the 5-imino-2-pyrazoline compounds employed. Effective protection of the colour photographic recording material against atmospheric aldehydes during storage is generally obtained with 100 mg of the 5-imino-2-pyrazoline per $m^2$ of recording material. It is preferred to use from 200 to 1000 mg of 5-imino-2-pyrazoline per $m^2$, and quantities of from 400 to 600 mg of 5-imino-2-pyrazoline per $m^2$ have proved to be particularly suitable.

In addition to gelatine, the layers of the recording material may contain other hydrophilic colloids, such as colloidal albumin, agar agar, gum arabic, detrans, alginic acid, cellulose derivatives, e.g. partially hydrolysed cellulose acetate, polyacrylamides, imidatised polyacrylamides, zein, vinyl alcohol polymers containing urethane/carboxylic acid groups or cyano acetyl groups, such as vinyl alcohol, vinyl-cyano acetate copolymers, polyvinyl alcohols, polyvinyl pyrrolidones, hydrolysed polyvinyl acetates, the polymers obtained from the polymerisation of proteins and saturated acylated proteins with monomers containing vinyl groups, polyvinylamines, polyaminoethyl methacrylates and polyethyleneimines.

The conventional hardeners may be employed, but carbamoyl-pyridinium compounds, which have been described, for example, in DE-A 2,225,230, DE-A 2,317,677 and DE-A 2,439,551, are preferred.

The aldehyde scavengers used according to the present invention have proved particularly advantageous inter alia because they do not impair the sensitometric properties of the photographic material although on the basis of the structural similarity thereof to the conventional magenta couplers of the pyrazolone series they should in principle be capable of coupling.

EXAMPLE A

Colour photographic recording materials for reversal processing are prepared by applying the layers indicated below successively to a layer support of cellulose triacetate coated with an adhesive layer.

Recording material A (Comparison)

1. A red-sensitized silver halide emulsion containing, per kg, 70 g of gelatine, 60 g of silver (96 mol-% thereof in the form of bromide and 4 mol-% in the form of iodide) and 55 g of cyan coupler I

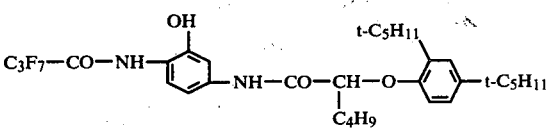

I

The silver application per $m^2$ is 2.5 g of silver nitrate.

2. A 2% aqueous gelatine solution containing per kg, 4 g of the polymeric white coupler II described in DE-A 2,304,319

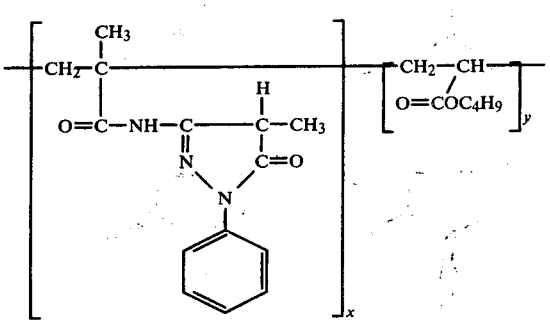

II

3. A green-sensitized silver halide emulsion containing, per kg, 70 g of gelatine, 60 g of silver (96 mol-% thereof in the form of bromide and 4 mol-% in the form of iodide) and 60 g of magenta coupler III

III

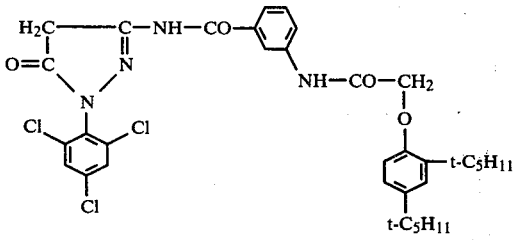

The silver application per $m^2$ is 2.8 g of silver nitrate.

4. A yellow silver dispersion containing, per liter, the quantity of silver corresponding to 1.8 g of silver nitrate and 12 g of gelatine. The colour density of the yellow filter layer measured behind a blue filter is 0.6; the silver application per $m^2$ is 0.2 g of silver nitrate.

5. A non-sensitized silver halide emulsion containing, per kg, 70 g of gelatine, 60 g of silver (95 mol-% thereof in the form of bromide and 5 mol-% in the form of iodide) and 140 g of yellow coupler IV

IV

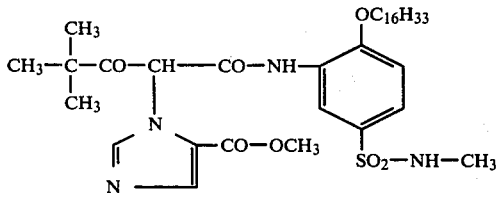

The silver application per $m^2$ amounts to 1.5 g of silver nitrate.

6. A 1% gelatine solution with a wet application of 60 g per $m^2$.

7. A 1% aqueous solution of hardener V with a wet application of 60 g per $m^2$:

V

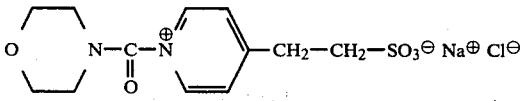

Recording material B (Comparison)

Material B corresponds to Material A, except that 10 g of N-methyl-barbituric acid are added to the casing solution for the yellow layer (Layer 5).

Recording material C (according to the present invention)

Material C corresponds to Material A, except that 10 g of Compound 3 are added to the casting solution for the yellow layer (Layer 5).

A sample from each of the Materials A, B and C was stored for 6 days at 23° C. in an 18 l container at the bottom of which was a mixture of 154 ml of glycerol, 38 ml of water and 8 ml of formalin (34%).

Another sample of each of the three Materials A, B and C was stored for 3 days at 60° C.

The pretreated samples mentioned above and another, untreated sample of each of the Materials A, B and C were subjected without previous exposure to a colour reversal development process described in "Manual for Processing Kodak Ektachrome Film using Process E 7", Eastman Kodak Company, 1977 (see Kodak Publication No. Z-119).

The magenta residual density of the pretreated samples is shown in Table 1 below as a percentage of the density in the untreated samples.

TABLE 1

| Material | Magenta residual density [%] after preliminary treatment | |
|---|---|---|
| | 6d; 23° C.; $CH_2O$ | 3d; 60° C.; — |
| A | 30 | 100 |
| B | 76 | 72 |
| C | 93 | 100 |

EXAMPLE 2

A photographic recording material D was prepared by applying the following layers in succession to a transparent layer support of polyethylene terephthalate coated with a light protective layer. The quantities given are based in each case on 1 $m^2$. The silver application is given in terms of the corresponding quantities of $AgNO_3$.

1. A comparatively less sensitive red-sensitized layer containing a silver iodobromide emulsions (6 mol-% AgI) of 3.4 g $AgNO_3$ with 1.0 g of cyan coupler VI, 40 mg of DIR coupler VII, 60 mg of red masking dye VIII and 3.0 g of gelatine.

VI

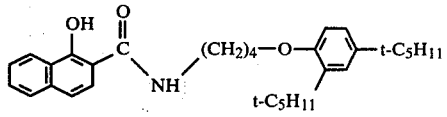

VII

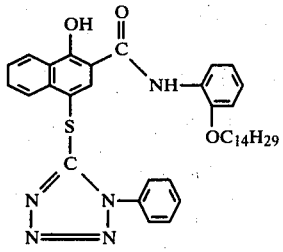

VIII

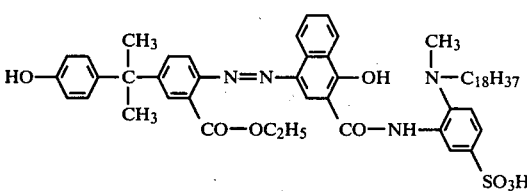

2. A highly sensitive red-sensitized layer containing a silver iodobromide emulsion (7 mol-% AgI) of 2.0 g $AgNO_3$ with 0.13 g of cyan coupler VI and 1.5 g of gelatine.
3. An interlayer of 0.6 g of gelatine.
4. A less sensitive green-sensitized layer containing a silver iodobromide emulsion (6 mol-% AgI) of 2.0 g $AgNO_3$ with 0.6 g of magenta coupler IX, 50 mg of DIR compound X, 50 mg of masking coupler XI and 3.0 g of gelatine.

IX

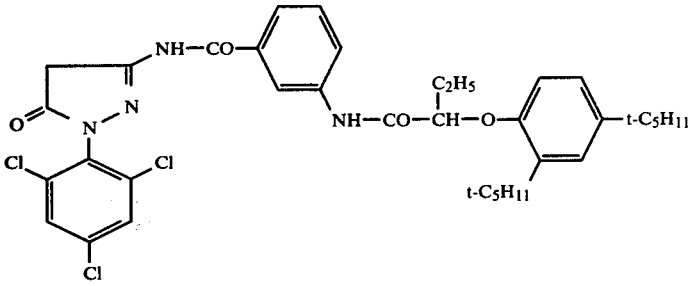

X

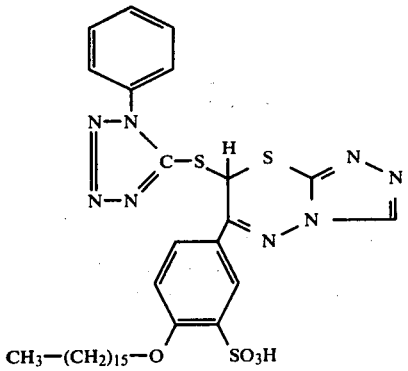

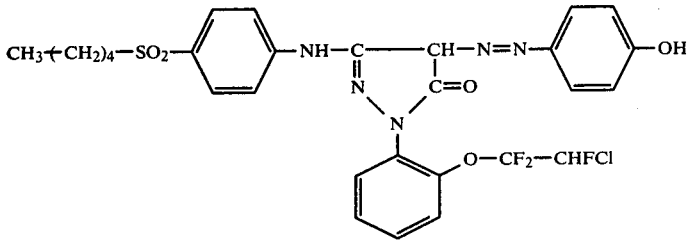

5. A highly sensitive green-sensitized layer containing a silver iodobromide emulsion (7 mol-% AgI) of 2.2 g $AgNO_3$ with 0.2 g of magenta coupler IX and 1.5 g of gelatine.

6. An interlayer containing 0.5 g of gelatine.

7. A yellow filter layer of colloidal silver, density 0.6.

8. A low sensitivity blue-sensitized layer containing a silver iodobromide emulsion (5 mol-% AgI) of 1.0 g of $AgNO_3$ with 1.0 g of yellow coupler XII and 1.3 g of gelatine.

XII

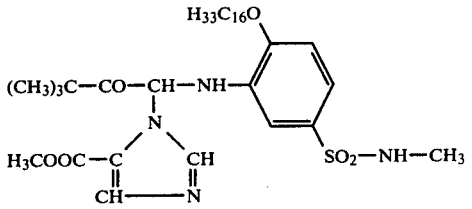

9. A high sensitivity blue-sensitized layer containing a silver iodobromide emulsion (7 mol-% AgI) of 0.6 g $AgNO_3$ and 0.3 g of yellow coupler XII and 0.7 g of gelatine.

10. A covering layer of 1.2 g of gelatine.

11. A covering layer of 0.25 g of gelatine and 0.8 g of hardener V.

Other recording materials E, F, G, H were prepared by a similar method, but with the difference that an additional 450 mg of a 5-imino-2-pyrazoline compound were incorporated in layer 10, as shown in Table 2 below. The 5-imino-2-pyrazoline compounds were added to the casting solution for layer 10 in the form of 10% aqueous or aqueous-ethanolic solutions.

To test for stability to formalin, a sample of each of the materials D, E, F, G, H (sample dimensions 35 mm×250 mm) was stored for 7 days at room temperature in a vessel (V=27 l) the bottom of which was covered with a mixture of 154 g of glycerol, 39 g of water and 7 ml of a 30% formaldehyde solution, and after exposure behind a grey step wedge, the sample was subjected to a process of colour development as described by E. Ch. Gehret in Brit/J.Photogr. 1974, 597.

Another sample of each of the materials D, E, F, G, H was exposed and developed in a similar manner, but without having been previously stored in an atmosphere containing formaldehyde.

The magenta residual densities measured in the pretreated samples are entered in Table 2 as percentages based on the magenta layer 1.5 above fog (=100%) of the untreated samples.

TABLE 2

| Material | Compound | Magenta residual density [%] after pretreatment with formaldehyde (7 days) |
|---|---|---|
| D | — | 51 |
| E | 11 | 76 |
| F | 1 | 97 |
| G | 3 | 84 |
| H | 24 | 68 |

We claim:

1. Colour photographic recording material containing at least one silver halide emulsion layer and a colour coupler associated therewith, containing an aldehyde scavenger in at least one light-sensitive or light-insensitive layer of binder, characterised in that the aldehyde scavenger contained in the material is a compound corresponding to the following general formula:

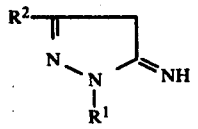

wherein $R^1$ represents hydrogen, an aliphatic or cycloaliphatic group, an aralkyl group, an aryl group, a heterocyclic group or one of the following groups: —CO—alkyl, —CO—aryl, —CO—heterocyclic, —$SO_2$—alkyl, —$SO_2$—aryl, —CO—O—alkyl, —CO—NH—$NH_2$,

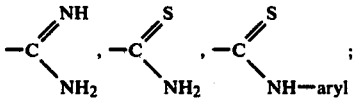

and $R^2$ represents hydrogen, an aliphatic or cycloaliphatic group, an aralkyl group, an aryl group, alkoxy, aroxy, carboxyl, carbamoyl, alkoxycarbonyl, an alkyl or aryl group attached through a carbonyl group, cyano, an amino group optionally substituted by alkyl, aralkyl, aryl or acyl, or a cyclic amino group.

2. Recording material according to claim 1, characterised in that the aldehyde scavenger is contained in one or more layers of binder in a (total) quantity of from 10 to 2000 mg/$m^2$.

3. Recording material according to claim 1, characterised by containing a magenta coupler derived from 3-acylaminopyrazolone or 3-anilinopyrazolone.

4. Recording material according to claim 1, characterised in that at least one layer contains gelatine as binder.

5. Recording material according to claim 4, characterised in that the gelatine was hardened with a N-carbamoyl pyridinium compound.

* * * * *